US006515209B2

(12) United States Patent
Pittman

(10) Patent No.: US 6,515,209 B2
(45) Date of Patent: Feb. 4, 2003

(54) ADD-ON HEADSTOCK MASS DEVICE FOR A STRINGED MUSICAL INSTRUMENT

(76) Inventor: Richard Aspen Pittman, 13994 Simshaw Ave., Sylmar, CA (US) 91342

( * ) Notice: Subject to any disclaimer, the term of this patent is extended or adjusted under 35 U.S.C. 154(b) by 0 days.

(21) Appl. No.: 09/848,653

(22) Filed: May 4, 2001

(65) Prior Publication Data

US 2002/0162443 A1 Nov. 7, 2002

(51) Int. Cl.[7] ..... G10G 7/00
(52) U.S. Cl. ..... 84/453; 84/267
(58) Field of Search ..... 84/453, 267, 290, 84/291

(56) References Cited

U.S. PATENT DOCUMENTS 4,829,870 A * 5/1989 Ralston ..... 84/291
4,840,102 A * 6/1989 Pittman ..... 84/293
5,217,213 A * 6/1993 Lii ..... 296/6
5,889,222 A * 3/1999 Burgess ..... 84/453
6,020,547 A * 2/2000 Chen ..... 84/415

* cited by examiner

*Primary Examiner*—Shih-Yung Hsieh
(74) *Attorney, Agent, or Firm*—J. E. McTaggart

(57) ABSTRACT

For enhancing the frequency response and sustain performance of a stringed musical instrument such as a guitar or electric bass, the present invention provides a mass-increasing device in the form of an adjustable metal U-shaped bracket forming a C-clamp that can be removably attached to the headstock of an instrument such as an acoustic guitar, electric guitar or electric bass. Clamping action is implemented by an screw-clamp assembly having a knurled thumb/finger knob at one end of a threaded shaft and a felt-padded pressure disc affixed at the other end, the threaded shaft traversing the major leg of the C-clamp. The device is normally clamped in place at an optimal location in the headstock near the instrument neck with the minor leg under the strings and the major leg and the screw-clamp assembly located on the reverse side of the headstock. Resilient pads are provided on the clamping pressure points to protect the finish on the instrument headstock.

6 Claims, 3 Drawing Sheets

ADD-ON HEADSTOCK MASS DEVICE FOR A STRINGED MUSICAL INSTRUMENT

FIELD OF THE INVENTION

The present invention relates to the field of stringed musical instruments and more particularly it relates to a high density headplate attachment that can be removably and selectively added onto the headstock of a stringed instrument such as a guitar or electric bass for improvements in sustain and frequency response.

BACKGROUND OF THE INVENTION

In musical instruments such as violins and guitars that generate sound from string vibration, it has been recognized that the quality of sound is influenced by the effective mass in the instrument in the vicinity of the string support or "bearing saddle" points at either end of the strings. Ideally the mass in these end points would be made infinitely large compared to the mass of the strings for ultimate sound quality and long sustain. While this effect has been taken into account to some extent and some times in the basic design of some higher quality stringed instruments, most present day instruments in the guitar family are somewhat deficient in mass in these critical regions at the ends of the strings, and could benefit substantially from the addition of more mass, e.g. in guitars, there has been a trend to make the headstock thinner as dictated by style and hardware considerations, and consequently lighter in weight and thus subject to improvement by the addition of mass.

DISCUSSION OF KNOWN ART

U.S. Pat. No. 4,840,102 by R. Aspen Pittman, the present inventor, discloses a high density headplate for a stringed instrument such as a guitar or electric bass to be installed between the headstock and the tuning machine, so as to effectively making the headstock thicker and/or denser than what is merely required for structural purposes, i.e. to support the tuning mechanism. Such structure is suited to original manufacture, and can be applied as a retrofit on existing instruments by in effect rebuilding the headstock. This involved removing the strings, dismounting the tuning mechanisms, removing the original headplate, replacing it with the denser/thicker one and then re-installing the tuning mechanisms and the strings, then retuning the instrument. In the case where the replacement headplate was thicker than the original, this changed the angle of the strings as they pass over the nut and proceed to the tuning pegs. Varying this angle affects the sustain and overall frequency response of the instrument U.S. Pat. No. 4,829,870 to Ralston teaches fastening metal plates onto various regions of a wooden guitar body surfaces including the headstock of electric guitars in order to obtain lighter overall weight and smaller body thickness profiles while maintaining superior sustain and tonal qualities.

U.S. Pat. No. 5,889,222 to Burgess discloses a device for altering the effective mass of stringed instrument such as a cello or violin to assuage objectionable tones such as the "wolf" from a violincello by affixing a movable mass to an accessory or member of the body of the instrument.

OBJECTS OF THE INVENTION

It is a primary object of the present invention to provide a convenient device for altering the mass of the headstock of a stringed musical instrument such as a guitar or string bass in order to improve the sustain and/or frequency response.

It is a further object to make the device for altering the mass easily installed and removed from the musical instrument headstock without tools.

It is a further object that the device for altering the mass can be installed in selected different regions of the headstock, It is a further object that the device for altering the mass does not affect the angle of the strings

SUMMARY OF THE INVENTION

The abovementioned objects have been accomplished in the present invention of a mass-increasing device in the form of a metal clamp that can be removably attached to the headstock of a stringed instrument such as an acoustic guitar, electric guitar or electric bass to add mass for improve the frequency response and sustain performance of the instrument. The device is made in the form of a U-shaped C-clamp with an adjustment screw having a knurled finger knob at one end and a felt-padded pressure disc at the other end, the screw traversing a wide leg of the clamp which is normally located toward the rear of the headstock. On the narrower opposite leg of the clamp, which is normally placed on the front surface of the headstock under the strings, a rubber cushion is provided to protect the finish on the instrument headstock. A standard version of the device is made optimal for standard guitars, and a slightly wider and heavier version is made and marketed for bass guitars.

BRIEF DESCRIPTION OF THE DRAWINGS

The above and further objects, features and advantages of the present invention will be more fully understood from the following description taken with the accompanying drawings in which.

DETAILED DESCRIPTION

Figure 1A:
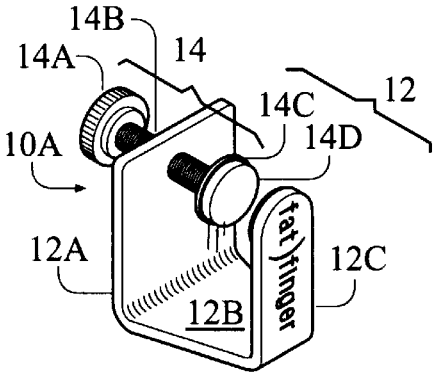
FIG. 1A is a perspective view of the headstock mass device of the present invention, in a first embodiment for electric guitars.

FIG. 1A is a perspective view of a first embodiment of the present invention showing headstock mass device 10A that is optimized for deployment on a regular electric guitar. The two elements of device 10A are a U-channel 12 and a clamp-screw assembly 14, constituting a C-clamp of designated mass that can be easily and removably attached to the headstock of an electric guitar or bass.

U-channel 12 is formed in generally in a U-shape from dense metal such as steel about 3 mm thick. The left hand leg 12A of U-channel 12, as shown in FIG. 1A, is relatively wide and the bottom 12B tapers down to the narrower width of the right hand leg 12C. Leg 12A is configured with a threaded hole in which the clamp-screw assembly 14 is threadedly engaged.

In clamp-screw assembly 14, a user-actuated knob 14A is configured with a knurled rim to facilitate user thumb-finger rotation. Knob 14A is affixed to threaded shaft 14B which engages the threaded hole in leg 12A of U-channel 12. Affixed at the end of the threaded shaft 14B is a metal clamp disk 14C fitted with a resilient pad 14D, typically made of felt, which co-operates with another protective resilient pad, not visible in this view, located in the opposite leg 12C of U-channel 12A to provide protection of the finish on the guitar headstock or other item to which the device is clamped. Clamp disk 14C can be made with a blind threaded hole and firmly tightened onto threaded shaft 14B, optionally bonded there adhesively, so as to cause clamp-screw assembly 14 to be captivated to U-channel 12.

Typically, in nominal dimensions, leg 12A is made 34 mm wide, leg 12C is made 15 mm wide, the U-channel, clamp disk 14C and the resilient pads are dimensioned to accommodate headstock thickness in the approximate range of 11 to 21 mm. In this first embodiment the total weight is made to be approximately 3.2 ounces which has been found optimal for typical electric guitars.

Figure 1B:
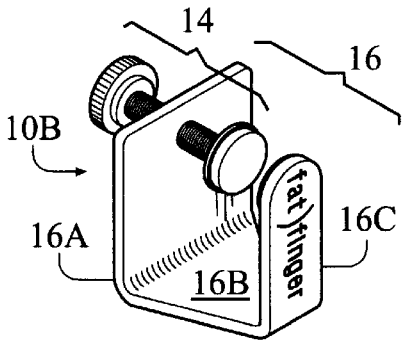
FIG. 1B is a perspective view of the headstock mass device of the present invention, in a second embodiment for electric bass guitars.

FIG. 1B depicts a headstock mass device 10B of the present invention in a second embodiment that is optimized for use on bass guitars: it is similar to device 12A of FIG. 1A except that, in U-channel 16, leg 16A is made wider, typically 44 mm, to increase the mass to 3.8 ounces which has been found optimal for bass guitars. Leg 16C is typically held to the same width in both embodiments, i.e. the same as in leg 12C (FIG. 1A) while the bottom 16B is shaped accordingly with a greater angle of taper.

Figure 2A:
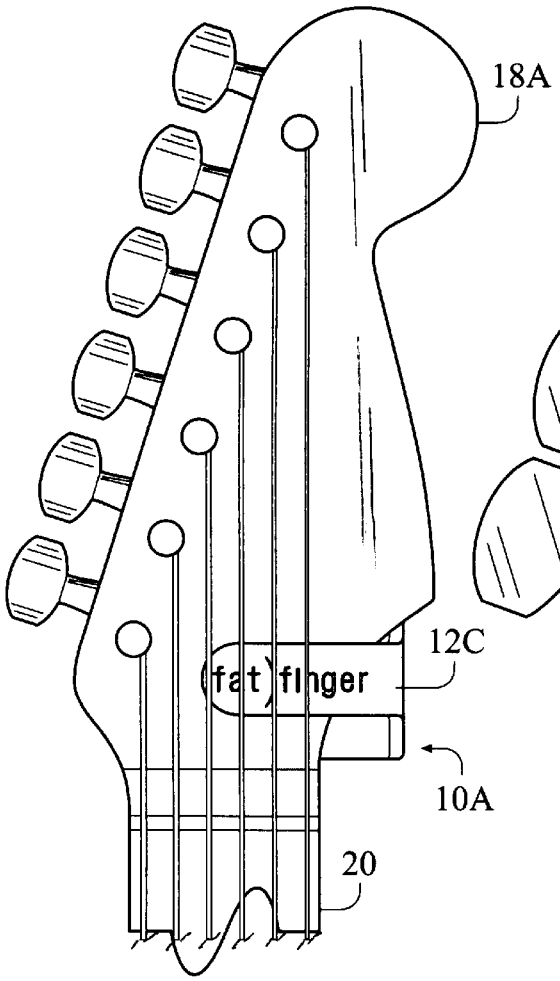
FIG. 2A depicts the headstock region of a guitar, as seen from the string side, fitted with the first embodiment, shown in FIG. 1A.
Figure 2B:
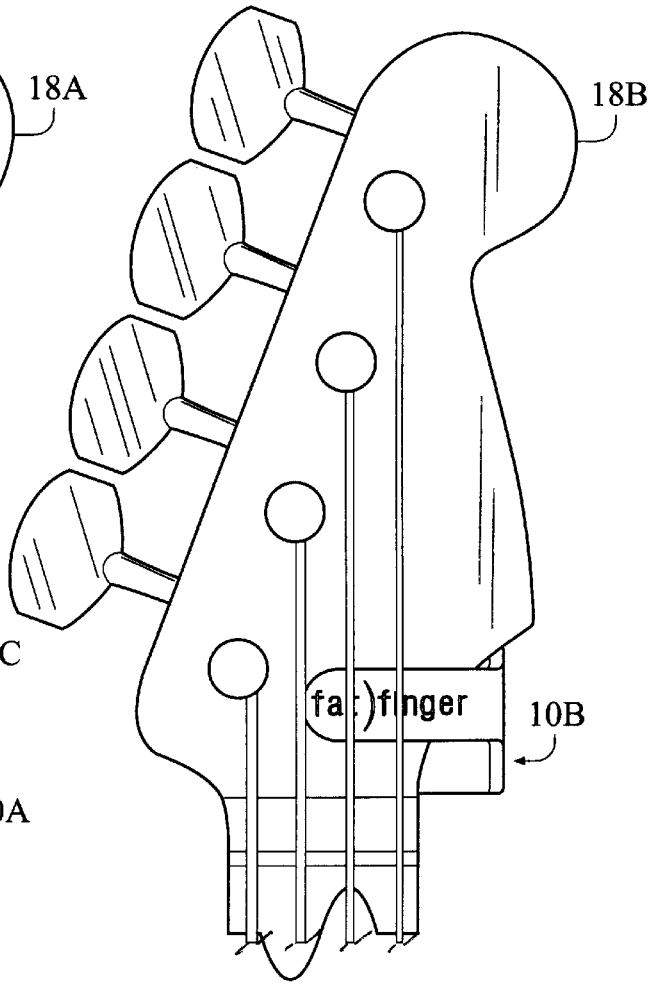
FIG. 2B depicts the headstock region of a bass guitar, as seen from the string side, fitted with the second embodiment, shown in FIG. 1B.

FIG. 2A depicts the string side of a head portion of an electric guitar fitted with a headstock mass device 10A as in FIG. 1A, the first embodiment of the present invention. The narrow leg 12C slides under the strings of the guitar and device 10A is clamped in place onto a region of the headstock 18A near the neck 20 and secured in place by the clamp-screw assembly on the reverse side, thus not visible in this view FIG. 2B depicts the string side of a head portion of an electric bass guitar fitted with a headstock mass device 10B of FIG. 1B, the second embodiment of the present invention deployed on the bass guitar in the same manner as shown for the regular guitar in FIG. 1A. In both instances there is some latitude for moving the mass device 10A/B around on the headstock 18A/B to determine an optimum location.

Figure 3A:
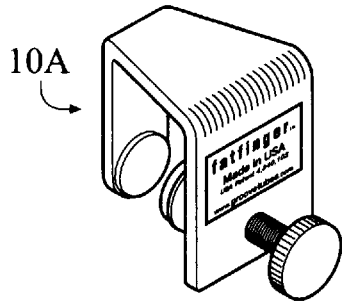
FIG. 3A is a perspective view of the first embodiment shown in FIG. 1A, rotated 180 degrees.
Figure 3B:
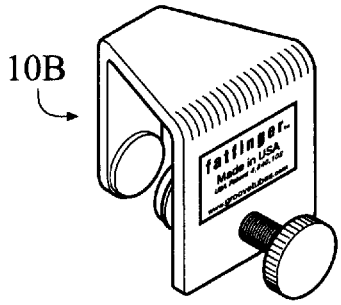
FIG. 3B is a perspective view of the second embodiment shown in FIG. 1B, rotated 180 degrees.

FIGS. 3A and 3B are perspective views of headstock mass devices 10A and 10B, i.e. first and second embodiments as in FIGS. 1A and 1B,7 shown rotated 180 degrees.

Figure 4A:
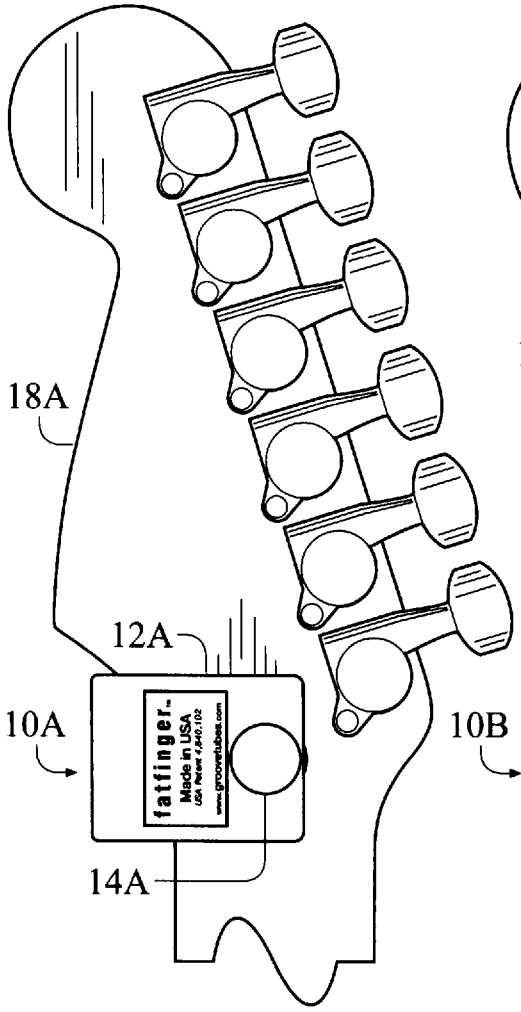
FIG. 4A shows the subject matter of FIG. 2A as viewed from the reverse side.
Figure 4B:
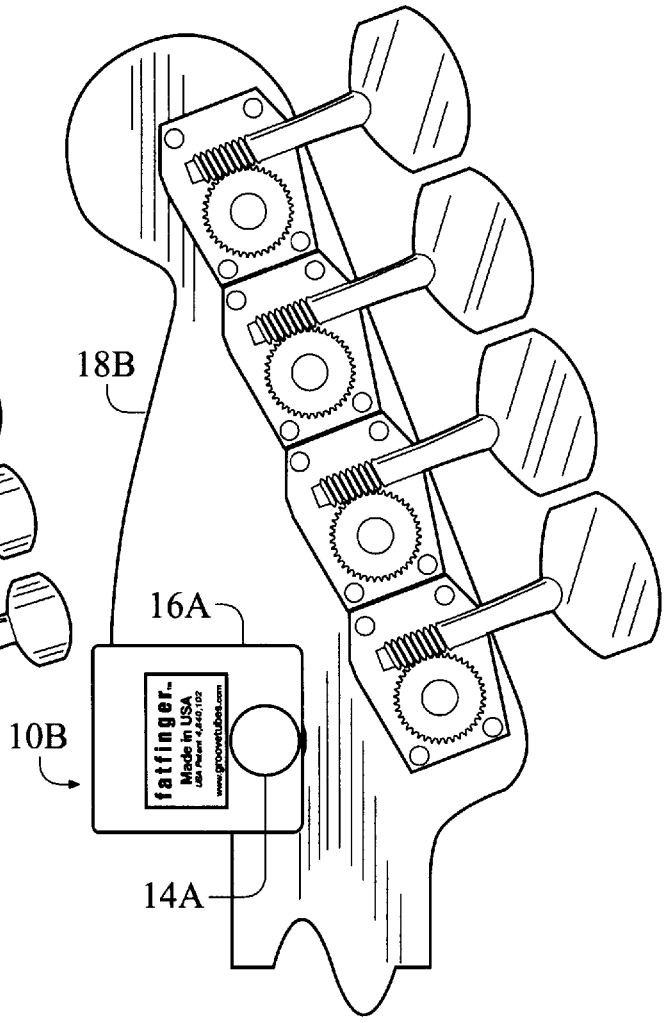
FIG. 4B shows the subject matter of FIG. 2B as viewed from the reverse side.

FIGS. 4A and 4B are views of the reverse side of headstocks 18A and 18B of FIGS. 2A and 2B fitted with mass devices 10A and 10B respectively, showing the knurled clamping knobs 14A and major legs 12A and 16A of the mass devices 10A and 10B.

Figure 5A:
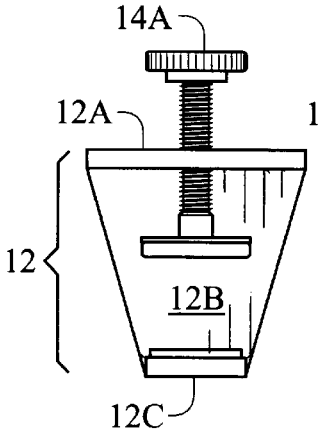
FIG. 5A is an orthogonal view of the open end of the first embodiment shown in FIGS. 1A–4A.
Figure 5:
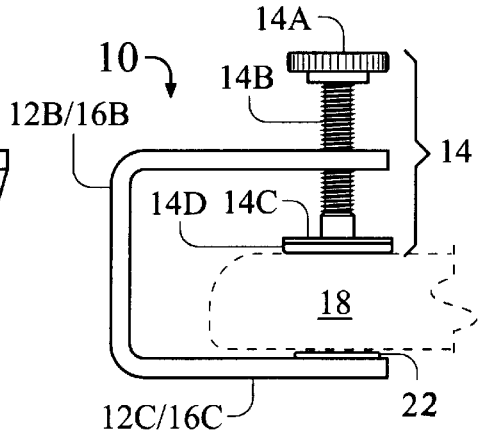
FIG. 5 is an orthogonal view showing the common profile of both of the embodiments of the present invention shown in FIGS. 1A–4B.

FIG. 5 is an orthogonal profile view of the headstock mass device 10 of the present invention; this view is applicable to both devices 10A and 10B as shown in FIGS. 1A thru 4B. Clamp-screw assembly 14 is shown, with knob 14A, threaded shaft 14B, clamp disk 14C and pad 14D, which is tightened down onto a headstock 18 shown in broken lines. A second resilient pad 22, affixed to leg 12C/16C as shown, acts with pad 14D to protect the finish on headstock 18.

Figure 5B:
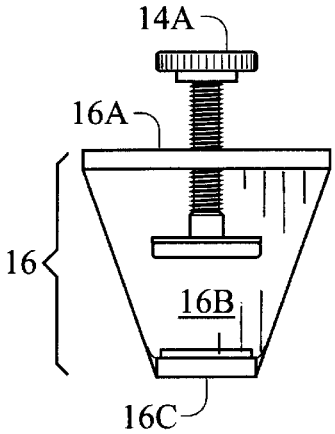
FIG. 5B is an orthogonal view of the open end of the second embodiment shown in FIGS. 1B–4B.

FIGS. 5A and 5B are orthogonal views of the open ends of the U-channels 12 and 16 of the two embodiments of the present invention shown in the foregoing FIGs with suffix A and B respectively.

Figure 6A:
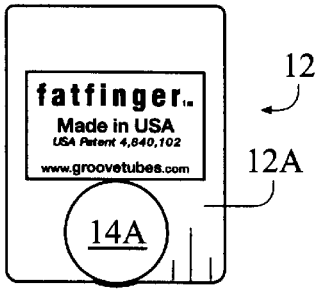
FIG. 6A is an orthogonal view showing the upper side of the first embodiment as shown in FIG. 5A.
Figure 6B:
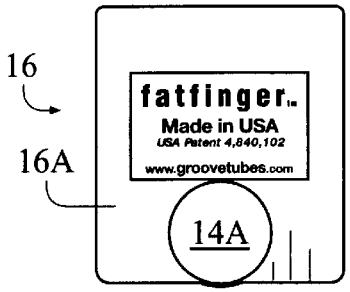
FIG. 6B is an orthogonal view showing the upper side of the second embodiment as shown in FIG. 5B.
Figure 7A:
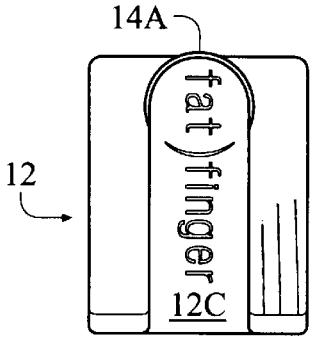
FIG. 7A is an orthogonal view showing the lower side of the first embodiment as shown in FIG. 5A.
Figure 7B:
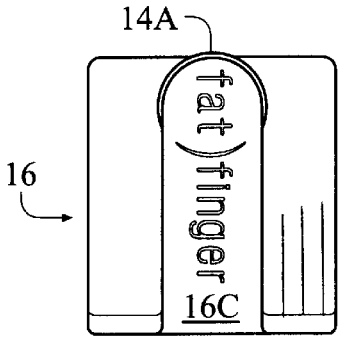
FIG. 7B is an orthogonal view showing the lower side of the second embodiment as shown in FIG. 5B.

Similarly FIGS. 6A and 6B are orthogonal views showing the major C-clamp legs 12A and 16A located near the top of FIGS. 5A and 5B respectively, and FIGS. 7A and 7B are orthogonal views showing the minor C-clamp legs 12C and 16C located at the bottom of FIGS. 5A and 5B respectively To provide instant visual identification, the two embodiments described above are preferably finished in a manner to be readily distinguishable, the first (guitar) embodiment being chrome-plated and the second (bass) embodiment being gold-plated.

The invention can be practiced with alternative shapes and proportions in the three major portions of the U-shaped channel 12/16, and in the cross-sectional profile shape which could be made to function in various shapes including C-shape and U-shape. Instead of the relatively square corners shown in FIG. 5, these corners could be made chamfered, individually rounded or commonly rounded in a semicircular shape. In a custom version this shape could be made to conform to the shape of the instrument headstock.

As an alternative to the screw-clamp assembly 14 above for fastening to the headstock, the invention could be practiced using different fastening arrangements, e.g. spring-loaded and/or made from a pair of hinged members.

Other options for removable fastening to the instrument could be provided by known fastening techniques such as pressure-sensitive tacky adhesive material or Velcro type hook-and-loop fabric fastenings, available with adhesive backing.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A removable mass-increasing device for attachment onto a headstock of a stringed musical instrument in a guitar-related group that includes acoustic guitar, electric guitar and electric bass, the headstock being characterized as having an initial mass, comprising:

a main body part made to have a predetermined mass for augmenting the initial mass of the headstock; and attachment means, for removably attaching said main body firmly onto the headstock of the instrument for increased mass and enhancement of sustain and other musical playing properties, comprising: (a) said main body being configured in a generally U-shape with a first leg and a second leg made and arranged to flank a portion of the headstock of the instrument; and (b) a clamping screw assembly, having a threaded shaft threadedly engaging a threaded opening provided in the first leg of said main body, having a head made and arranged to be rotated manually by a user, and having a bearing disk attached on an end of the threaded shaft opposite the head, disposed between the first and second legs of said main body, made and arranged to act as a C-clamp for removable attachment of said main body to the headstock; the first leg being made substantially wider than the second leg.

2. The removable mass-increasing device as defined in claim 1 wherein the head of said clamping screw is made cylindrical in shape and provided with a knurled outer surface to facilitate rotational screw adjustment while held between a thumb and finger.

3. The removable mass-increasing device as defined in claim 1 wherein said device is directed to regular electric guitars and wherein the predetermined mass is made to be approximately 3.2 ounces.

4. The removable mass-increasing device as defined in claim 1 wherein said device is directed to electric bass guitars and wherein the predetermined mass is made to be approximately 3.8 ounces.

5. The removable mass-increasing device as defined in claim 2 implemented as a visually-related product line, comprising;

at least two embodiments of said mass-increasing device made similar with regard to said attachment means and with regard to width of the second leg, but made different with regard to width of the first leg in order to obtain corresponding different designated values of the predetermined mass for different categories of guitars.

6. The removable mass-increasing device as defined in claim 1 implemented as a visually-related product line, comprising;

a first embodiment of said mass-increasing device wherein the first leg is made approximately 34 millimeters wide and the second leg is made approximately 15 millimeters wide, directed to regular electric guitars; and a second embodiment of said mass-increasing device made the first leg is made approximately 44 millimeters wide and the second leg is made approximately 15 millimeters wide, directed to electric bass guitars.

* * * * *